United States Patent [19]

Brungsberg

[11] 4,004,560

[45] Jan. 25, 1977

[54] INTERRUPTER FOR THE IGNITION SYSTEM OF INTERNAL COMBUSTION ENGINES

[75] Inventor: Josef-Heinrich Brungsberg, Ludenscheid, Germany

[73] Assignee: Brown, Boveri & Cie A. G., Mannheim, Germany

[22] Filed: Oct. 14, 1975

[21] Appl. No.: 621,918

Related U.S. Application Data

[63] Continuation of Ser. No. 432,367, Jan. 10, 1974, abandoned.

[30] Foreign Application Priority Data

Jan. 18, 1973 Germany ..... 2302287

[52] U.S. Cl. ..... 123/148 E; 335/206; 123/148 DK

[51] Int. Cl.² ..... F02P 1/00

[58] Field of Search ..... 335/206, 205, 207; 123/148 E, 148 CB, 146.5 A, 148 DK

[56] References Cited

UNITED STATES PATENTS

| | | | |
|---|---|---|---|
| 3,291,109 | 12/1966 | Neapolitakis | 123/148 |
| 3,359,455 | 12/1967 | Koda | 123/148 |

*Primary Examiner*—Ronald B. Cox
*Attorney, Agent, or Firm*—Erwin Salzer

[57] ABSTRACT

An interrupter for internal combustion engines includes fixed reed-switch type contact means which are caused to be opened and closed at the proper points of time by means of magnetic fields generated by a rotatable formed by magnetic particles and an insulating binder and armature having alternating magnetic field zones and zones which do not produce significant magnetic fields. The reed-switch contact means are enclosed in a multifunction housing.

1 Claim, 9 Drawing Figures

12,13,14,17
15
15
0°
90°
180°
270°
360°
a)
N
S
N
S
7a
7
8a
B
8
5
6
15
15
12,13,14,17
b)
N
S
N
S
B
7
8
5
6
12,13,14,17
c)
N
S
N
S
B
7
8
5
6

N
S
c
b
a
0°
90°
180°
270°
360°
γ

INTERRUPTER FOR THE IGNITION SYSTEM OF INTERNAL COMBUSTION ENGINES

This is a continuation of application Ser. No. 432,367, filed Jan. 10, 1974, now abandoned.

BACKGROUND OF THE INVENTION

Interrupters for internal combustion engines include relatively movable contacts supported by a base plate and operated by a shaft driven by the internal combustion engine. These contacts interrupt at proper points of time the primary circuit of an ignition coil which stores in magnetic form the energy required for firing the spark plugs. When the primary circuit of the ignition coil is interrupted, a high voltage is generated in the secondary circuit of the ignition coil which voltage is used for firing the spark plugs, thus igniting the combustible mixture of air and gas in the cylinder or cylinders of the internal combustion engine.

The primary winding of an ignition coil is energized by a battery having a relatively low voltage, and the high voltage generated in the secondary winding of the ignition coil is distributed by a distributor to the spark plugs of the various cylinders of an internal combustion engine. The interrupter includes a cam mounted on, and driven by, the shaft of the distributor which, in turn, is driven by the internal combustion engine. The cam operates an interrupting lever which supports one of the two cooperating contacts of the interrupter, or the movable contact thereof, and causes separation of said one of the two cooperating contacts from the other or fixed contact of the interrupter.

The number of contact-operating cams which are mounted on the shaft of the distributor is equal to the number of cylinders of the internal combustion engine. Hence the shaft of the distributor of a four cylinder internal combustion engine will support four contact operating cams and will cause four interruptions of the primary circuit of the ignition coil at each revolution of said shaft. Hence each spark plug of each cylinder is supplied during each revolution of the shaft of the distributor by the intermediary of the distributor with one spark-plug-firing pulse. The relatively movable contacts of the interrupter are provided with arc-resistant overlays as, for instance, tungsten. Nevertheless the contacts of the interrupter are subject to erosion which becomes particularly apparent after the internal combustion engine of a motor vehicle has an aggregate mileage of about 10,000 miles. The aforementioned contact erosion calls for very undesirable costly service operations.

In electronic ignition systems, e.g. ignition systems including transistors, the contacts of the interrupter must carry much smaller currents than in the aforementioned interrupters of more conventional or obsolescent design. These more advanced transistorized ignition systems have been combined with reed-type contacts and are much more satisfactory than the aforementioned prior art ignition systems but are and not entirely satisfactory.

Efforts to provide interrupters requiring less servicing had but limited succes which is, in part, due to technical limitations and in part to the high cost of advanced interrupter systems. For instance, opto-electronic interrupters are subject to the formation of deposits of oil condensates on their light-sensitive elements, as a result of which opto-electronic systems may become inoperative. Other electronic ignition systems are temperature sensitive and rather impractical on account of this limitation. Most prior art electronic ignition or interrupter systems for internal combustion engines require excessive wiring.

The main object of the present invention is to provide an ignition system for internal combustion engines, and more particularly an interrupter therefor which is of the reed-switch type and which minimizes the cost of manufacture, servicing and repairs.

SUMMARY OF THE INVENTION

Interrupters for internal combustion engines embodying this invention include a fixed reed-type switch having relatively movable contacts enclosed in a gas-tight envelope and a shaft-supported rotatable magnetic system formed by magnetic particles and an insulating binder controlling sequential opening operations and closing operations of said contacts of said reed-type switch. The latter is housed in a multifunction support.

DESCRIPTION OF PREFERRED EMBODIMENTS

Figure 1:
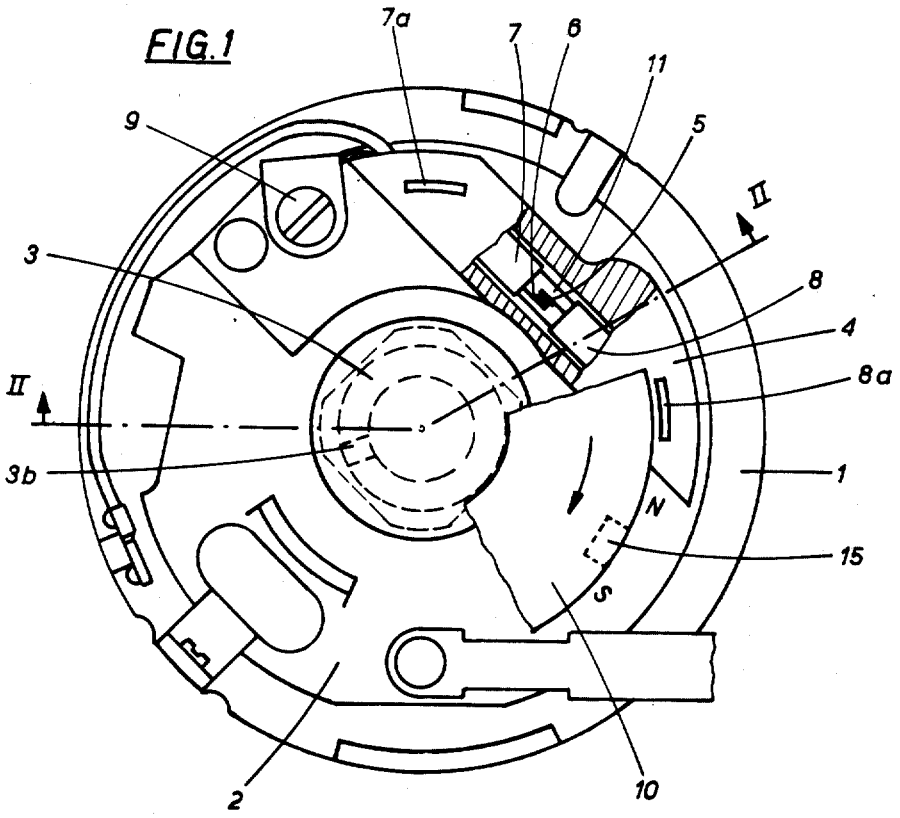
FIG. 1 is a top-plan view of an interrupter embodying this invention drawn on a relatively large scale.
Figure 2:
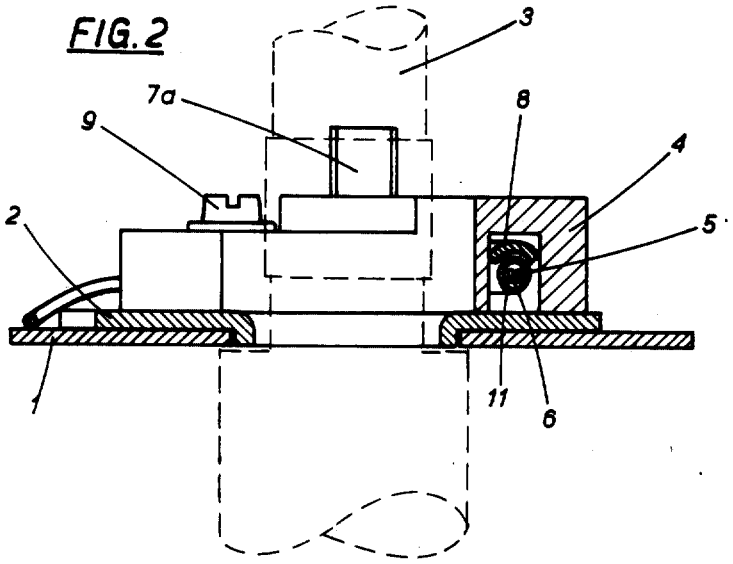
FIG. 2 is a section substantially along II—II of FIG. 1 except for the fact that the rotatable magnet shown in FIG. 1 has been deleted in FIG. 2.

In FIGS. 1 and 2 reference numeral 1 has been applied to indicate the base plate of a distributor housing and reference numeral 2 has been applied to indicate the base plate of the interrupter mechanism. Plate 2 is arranged above plate 1 and in parallel relation to plate 1. The shaft 3 of the distributor indicated in dotted lines is intended to project transversely through plates 1 and 2. The insulating plate 2 supports a socket 4 likewise of insulating material for a reed-type switch. This reed-type switch includes reed contacts 5 and 6 enclosed in a gas-tight envelope, magnetic receivers or reed-energizing elements 7 and 8 and screw terminal 9. Magnetic ring 10 is mounted on shaft 3 and affixed to shaft 3 in such a way as to be jointly rotatable with shaft 3. In FIG. 2 reference numeral 11 has been applied to indicate the envelope of glass housing reed contacts 5 and 6. FIG. 2 shows further that the magnetic receivers or reed-energizing elements 7 and 8 which are formed by laminations of soft iron are arranged immediately adjacent to glass envelope 11. FIG. 1 shows that the ends 7*a*,8*a* of magnetic receivers, or reed-energizing elements remote from glass envelope 11 are bent 90° and project out of insulating socket 4.

The drawings illustrate two rotatable annular magnet systems. One embodiment is shown to FIGS. 3 and 4 and the other embodiment, according to the present invention is shown in FIGS. 5 and 6.

Figure 3:
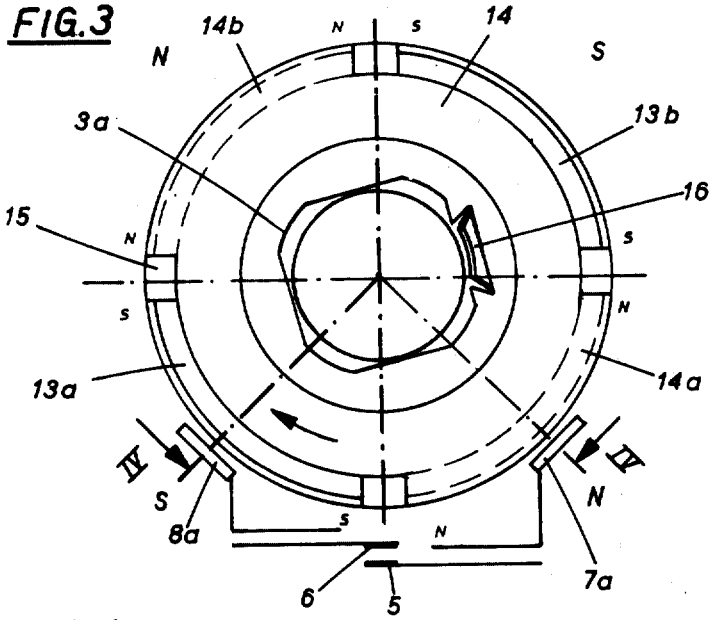
FIG. 3 is a bottom plan view of one possible embodiment of an annular rotatable magnet system for the interrupter shown in FIGS. 1 and 2.
Figure 4:
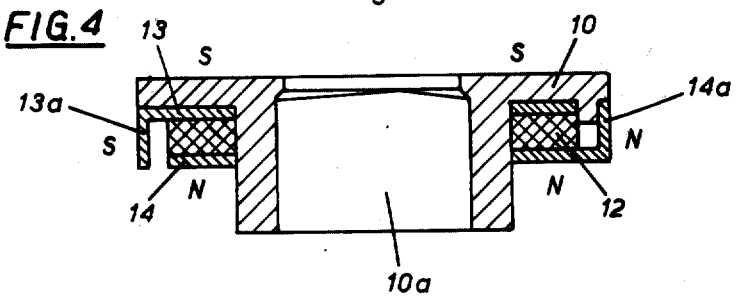
FIG. 4 is a section along IV—IV of FIG. 3.

Referring now to FIGS. 3 and 4, numeral 12 has been applied to indicate an annular permanent magnet. This magnet is magnetized in axial direction so that one of its end surfaces has one polarity and the other of its end surfaces has a polarity opposite to said one polarity. As shown in FIG. 4 the upper end surface of annular permanent magnet 12 is a magnetic south pole and the lower end surface of annular permanent magnet 12 is a magnetic north pole. The plate 13 of soft iron is arranged in abutting relation to the upper end surface of permanent magnet 12 and provided with depending projections 13*a* and 13*b* which are angularly displaced 180°. In a like fashion the plate 14 of soft iron is arranged in abutting relation to the lower end surface of permanent magnet 12 and provided with upstanding projections 14*a* and 14*b* which are angularly displaced 180°. It will be apparent from the above that plate 13 and its projections 13*a* and 13*b* form magnetic south poles and that plate 14 and its projections 14*a* and 14*b* form magnetic north poles. It will further be apparent from a consideration of FIG. 3 that there are gaps between contiguous projections 13*a*,14*a*,13*b*,14*b* or a total of four such gaps. There is no significant magnetic flux in these gaps or magnetically neutral zones 15. The toroidal or annular magnet 12 and its soft iron laminations 13 and 14 are supported by a support 10 of electric insulating material, best shown in FIG. 4, but also indicated in FIG. 1. Support 10 is jointly rotatable with the shaft 3 of the distributor. Spring 16 shown in FIG. 3 is provided for a good fit of support 10 on shaft 3.

It may be desirable to convert conventional interrupters having contact-operating cams into interrupters having reed switches In such instances support 10 forms a cavity 10*a* as shown in FIG. 4 which is adapted to receive the contact-operating cams 3*a* shown in FIG. 3.

Figure 5:
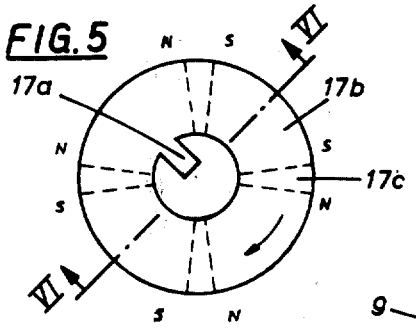
FIG. 5 is a top-plan view of an annular rotatable magnet system embodying the present invention intended for the interrupter of FIGS. 1 and 2.
Figure 6:
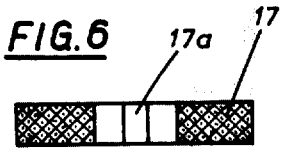
FIG. 6 is a section along VI—VI of FIG. 5.

Referring now to FIGS. 5 and 6 showing a magnetic rotor embodying the present invention numeral 17 has been applied to indicate a magnet made of magnetic particles which are bonded together by an insulating material. In the structure of FIGS. 5 and 6 the magnetic end plates 13,14 of FIGS. 3 and 4 are dispensed with. The toroidal magnet 17 has a cylindrical central bore and a projection 17*a* extends radially inwardly into said bore. This projection 17*a* is intended to engage a recess or groove in the shaft operating or rotating magnet 17 conforming to the shape of projection 17*a*. This has been clearly shown in FIG. 5. In FIG. 1 reference numeral 3*b* has been applied to indicate a recess or groove in shaft 3 intended to receive the projection 17*a* of the annular or toroidal magnet 17 shown in FIGS. 5 and 6. The annular magnet shown in FIGS. 5 and 6 includes four sector-shaped magnetic zones 17*b* which are angularly displaced 90° and four sector-shaped nonmagnetic zones, or neutral zones, 17*c* which are angularly displaced 90°. The number of each zone 17*b* and 17*c* is equal to the number of contact separations and contact engagements to be effected by the above referred-to reed switch during each revolution of shaft 3. Parts 17*b* and 17*c* are self-supporting and, therefore, the embodiment of the rotatable magnet structure shown in FIGS. 5 and 6 does not require a support performing the function of support 10 in the structure of FIGS. 3 and 4.

Figure 7:
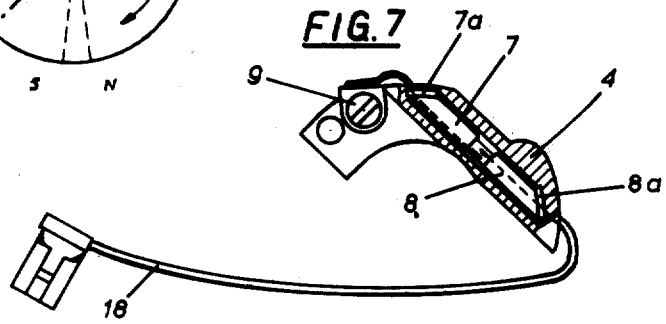
FIG. 7 is in part a top-plan view of and in part a section of the stationary contact system for the structure of FIGS. 1 and 2 including a reed switch and a cable connection for the latter.

When assembling the interrupter structure which has been described above, the reed switch with its contacts 5 and 6 and its magnetic receivers 7 and 8 and its terminal 9 is secured to plate 2. Terminal 9 connects one of the contacts of the reed switch to the body or the mass of the internal combustion engine, and the flexible conductor or cable 18 (see FIG. 7) connects the other terminal of the reed switch to the ignition system proper, or to its ignition coil.

Rotation of shaft 3 and its magnetic rotor 10 results in exposing the reed switch alternatingly to magnetic fields of opposite polarity. There are intervals between these events during which the reed switch is not subjected to any significant magnetic action. This applies irrespective of whether the magnetic rotor is formed by the structure of FIGS. 3 and 4 including parts 12,13,13*a*,13*b*,14,14*a*,14*b* and 10, or is formed by the structure of FIGS. 5 and 6 including the part 17*b* and 17*c*. When a magnetic north pole is swept past magnetic receiver or reed-energizing element 7,7*a*, the latter is turned into a magnetic north pole, and when a magnetic north pole is swept past magnetic receiver or reed-energizing element 8,8*a* the latter is turned into a magnetic north pole. The same applies as to magnetic south poles. If a magnetic south pole is swept past magnetic receiver or reed-energizing element 7,7*a* the latter is turned into a magnetic south pole, and when a magnetic south pole is swept past magnetic receiver or reed-energizing element 8,8*a*, the latter is turned into a magnetic south pole.

Assuming that at a given instant magnetic receiver or reed-energizing element 7,7*a* has been magnetized inductively by rotor 10 to turn into a south pole and that at that instant magnetic receiver or reed-energizing element 8,8*a* has been magnetized inductively by rotor 10 to turn into a magnetic north pole. As a result, reed contacts 5,6 will assume opposite magnetic polarities since they are made of magnetizable material and attract each other and close the circuit controlled by the reed switch. Closing of the contacts of the reed switch results in closing of the primary circuit of the ignition coil. In order to produce a high voltage pulse by means of the ignition coil the contacts of the reed switch must be reopened. This is achieved on account of the fact that each energization of magnetic receivers or reed-energizing elements 7,7*a*;8,8*a* is followed by a deenergization thereof, as a result of which contacts 5,6 part from each other due to their inherent resiliency. Parting of contacts 5,6, in turn, generates a high voltage pulse in the secondary winding of the ignition coil which causes firing of one of the spark plugs of the internal combustion engine. The flux path through the reed switch includes the bent ends 7*a*,8*a* of the magnetic receivers or reed-energizing elements which are separated from magnetic rotor 10 — either in its form shown in FIGS. 3 and 4, or in its form shown in FIGS. 4 and 5 — by narrow air gaps.

Figure 8:
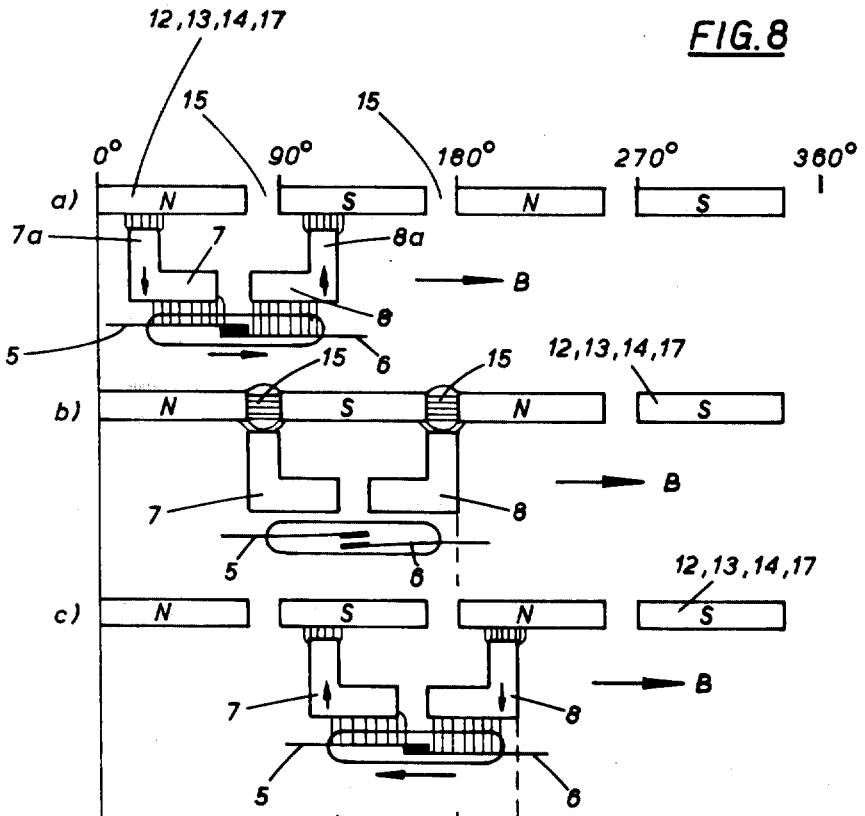
FIG. 8 is a diagrammatic representation of the structure of FIGS. 1 and 2 intended to illustrate the mode of operation thereof.

FIG. 8(a),8(b) and 8(c) show three sequential stages of the operation of the structure of FIGS. 1 to 4, inclusive. Instead of assuming that the reed switch is stationary and the magnetic rotor 10 movable it has been assumed in drawing FIG. 8 that the reed switch is movable and the magnetic rotor 10 fixed. This assumption is permissible since the operation of the interrupter is predicated upon a relative movement of the reed switch and the magnetic system for energizing the reed switch. In the position of parts shown in FIG. 8(a) parts 7a,7 form a magnetic north pole and parts 8a,8 form a magnetic south pole. The direction of the flux through parts 7a,7, contacts 5,6 and parts 8,8*a* has been indicated by small arrows. As a result of the opposite magnetization of contacts 5,6, contacts 5,6 engage, thus closing the primary circuit of the ignition coil.

FIG. 8(b) shows a subsequent position of parts when the magnetic reluctance across the reed switch by far exceeds the magnetic reluctance between magnet poles N,S of opposite polarity so that some leakage flux extends between contiguous magnet units N,S, yet the magnet system 7*a*,7,8,8*a* of the reed switch remains de-energized. This, in turn, results in separation of contacts 5,6 and generation of a high voltage pulse in the secondary circuit of the ignition coil. FIG. 8(c) shows how contacts 5,6 of the reed switch are caused to re-engage on account of the inductive magnetization of the magnetic system 7*a*,7,8,8*a* of the reed switch. It will be noted that the direction of the magnetic flux shown in FIG.8(c) is opposite to the direction of the magnetic flux shown in FIG.8(a). While in the position of parts shown in FIG.8(a) reed contact 5 is a magnetic north pole and reed contact 6 a magnetic south pole, in the position of parts shown in FIG.8(c) reed contact 5 is a magnetic south pole and reed contact 6 a magnetic north pole. However, in both instances under consideration both reed contacts 5 and 6 are magnetic poles of opposite polarities, and hence attract each other.

Figure 9:
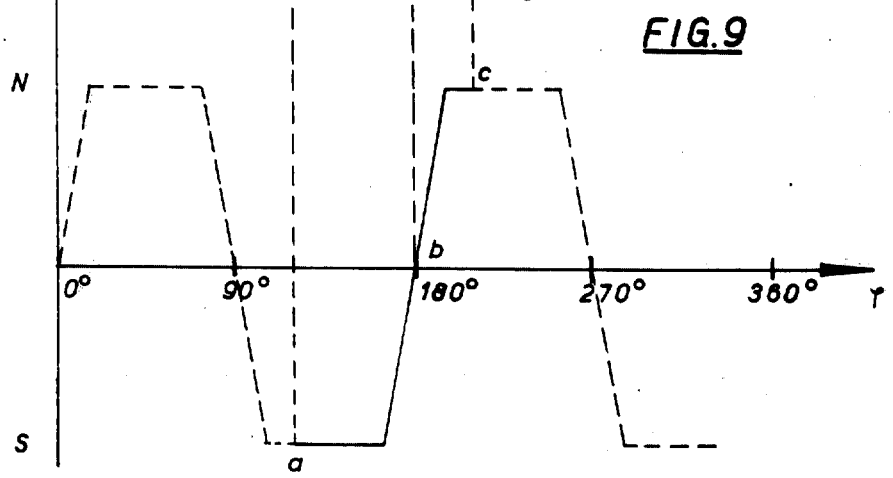
FIG. 9 is a diagrammatic representation of the magnetization in the magnetizable receivers of the structure of FIGS. 1 and 2.

FIG. 9 is a plot showing how the magnetization of parts 7*a*,7, 8*a*,8 is established. The ordinates of this figure are magnetic polarity and the abzissae of this figure indicate the position of the movable parts of the system embodying this invention expressed in terms of angular displacement of these parts. Considering the angular position at the point of time *a*, it will be apparent that at that angle or point of time a maximal magnetic south polarity is imparted, that at the angle or point of time *b* the magnetization is zero and that at the angle or point of time *c* maximum positive polarity is imparted.

The degree of precision of timing which can be achieved with a magnetic interrupter as described above exceeds by far the degree of precision of timing achievable with prior art interrupters for ignition systems of internal combustion engines. The reed contacts forming part of this system operate more uniformly than the contacts of any prior art interrupters for ignition systems of internal combustion engines. The angular relations at which firing pulses are to be given remain rigorously constant and contact bounce is entirely eliminated. As a result of these performance characteristics the cost of servicing and of repair are drastically reduced.

I claim as my invention:

1. An interrupter for ignition systems of internal combustion engines including a. a fixed, normally open reed-type switch having a pair of relatively movable contacts enclosed in a gas-tight envelope for controlling the primary circuit of an ignition coil;

b. a rotatable magnet system for operating said reed-type switch, said magnet system having a plurality of spaced alternating zones of opposite magnetic polarity;

c. a shaft supporting said magnet system arranged at right angles to the axis of said reed-type switch;

d. a pair of magnetizable reed-energizing elements each having one end immediately adjacent to one of said pair of contacts of said reed-type switch and another end remote from said pair of contacts of said reed-type switch and immediately adjacent to the trajectory of said zones of opposite magnetic polarity of said rotatable magnet system; wherein the improvement comprises in that e. the rotatable magnet system is substantially in the shape of a toroid consisting of magnetic particles and an insulating binder therefor and radially magnetized so as to form a plurality of sectors each having opposite polarities on opposite ends thereof, contiguous of said plurality of sectors being separated from each other by intervening non-magnetic sectors, said reed-type switch opening and closing during said plurality of sectors of opposite magnetic polarity of said magnet system passes the ends of said reedenergizing elements;

f. said reed-type switch is housed for itself inside a separate socket of insulating material totally enclosing said reed-type switch except the ends of said reed-energizing element, said socket having a pair of slots forming passageways narrowly surrounding and positioning said reed-energizing elements, said reed-energizing elements and said passageways being bent so that the ends of said reed-energizing elements are situated above said reed-type switch in a cylindrical surface juxtaposed to the lateral surface of said rotatable magnet system; and g. said socket further supporting a pair of terminals for connecting said reed-type switch into an electric circuit.

* * * * *